US009051678B2

(12) United States Patent
Kim et al.

(10) Patent No.: US 9,051,678 B2
(45) Date of Patent: Jun. 9, 2015

(54) LAUNDRY MACHINE

(75) Inventors: Young Suk Kim, Changwon-si (KR); Hyun Seok Seo, Changwon-si (KR); Suk Yun Moon, Changwon-si (KR); Dong Il Lee, Changwon-si (KR); Ig Geun Kwon, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1014 days.

(21) Appl. No.: 13/142,702

(22) PCT Filed: Dec. 24, 2009

(86) PCT No.: PCT/KR2009/007802

§ 371 (c)(1),
(2), (4) Date: Sep. 27, 2011

(87) PCT Pub. No.: WO2010/077025

PCT Pub. Date: Jul. 8, 2010

(65) Prior Publication Data

US 2012/0006069 A1 Jan. 12, 2012

(30) Foreign Application Priority Data

Dec. 30, 2008 (KR) ..... 10-2008-0136370
Aug. 27, 2009 (KR) ..... 10-2009-0079908
Dec. 24, 2009 (KR) ..... 10-2009-0130569

(51) Int. Cl.
*D06F 37/22* (2006.01)
*D06F 37/04* (2006.01)
(Continued)

(52) U.S. Cl.
CPC ..... *D06F 37/225* (2013.01); *D06F 37/04* (2013.01); *D06F 37/206* (2013.01); *D06F 37/22* (2013.01); *D06F 37/268* (2013.01); *D06F 37/269* (2013.01)

(58) Field of Classification Search
CPC ..... D06F 37/225; D06F 37/22; D06F 37/26; D06F 37/263; D06F 37/266; D06F 37/268
USPC ..... 68/23.1, 23.2, 24, 139, 140, 141, 142
See application file for complete search history.

(56) References Cited

U.S. PATENT DOCUMENTS 5,850,749 A 12/1998 Kim ..... 68/23.2
5,916,274 A * 6/1999 Lee et al. ..... 68/23.2
(Continued)

FOREIGN PATENT DOCUMENTS

CN 1203979 1/1999
DE 198 49 594 C1 3/2000
(Continued)

OTHER PUBLICATIONS

Russian Office Action dated Jan. 22, 2014 issued in Application No. 2011131879 (with English translation).
(Continued)

*Primary Examiner* — Joseph L Perrin
(74) *Attorney, Agent, or Firm* — Ked & Associates, LLP

(57) ABSTRACT

Disclosed is a laundry machine having an increased wash capacity. The laundry machine includes a cabinet, a tub connected to vibration sources through a vibration transmission blocking member, a drum rotatably provided in the tub, a suspension unit to substantially damp and support the vibration sources, and ball balancers, each of which includes a race, balls contained in the race, and an oil filing the race, provided on the drum.

16 Claims, 8 Drawing Sheets

(51) Int. Cl.
*D06F 37/20* (2006.01)
*D06F 37/26* (2006.01)

(56) References Cited

U.S. PATENT DOCUMENTS

| | | | | |
|---|---|---|---|---|
| 2005/0274159 | A1* | 12/2005 | Jeon et al. | 68/23.1 |
| 2007/0017261 | A1* | 1/2007 | Chang et al. | 68/23.1 |
| 2008/0110212 | A1 | 5/2008 | Kim et al. | 68/23.2 |
| 2008/0256987 | A1* | 10/2008 | Jung et al. | 68/23.2 |

FOREIGN PATENT DOCUMENTS

| | | | |
|---|---|---|---|
| EP | 1 619 286 | A2 | 1/2006 |
| EP | 1 983 089 | A1 | 10/2008 |
| KR | 20-2000-0013772 | U | 7/2000 |
| KR | 10-0826206 | B1 | 4/2008 |
| KR | 10-2008-0042606 | A | 5/2008 |
| RU | 2 303 092 | C1 | 7/2007 |
| RU | 77 872 | U1 | 11/2008 |
| WO | WO 2008/103007 | A2 | 8/2008 |

OTHER PUBLICATIONS

International Search Report and Written Opinion dated Aug. 9, 2012 issued in Application No. PCT/KR2009/007802.
Korean Office Action dated Oct. 18, 2011 issued in Application No. 10-2009-0130569.
Chinese Office Action for Application No. 200980155599.3, dated May 28, 2013 (Full Chinese Text with English Translation).
European Search Report dated Sep. 30, 2014 issued in Application No. 09836346.8 (English text).

* cited by examiner

LAUNDRY MACHINE

TECHNICAL FIELD

The present invention relates to a laundry machine, and more particularly, to a laundry machine which has an increased capacity and improved vibration characteristics.

BACKGROUND ART

In general, a laundry machine is an apparatus which removes contaminants from laundry contained in a drum to wash the laundry using actions of wash water and a detergent supplied to the inside of a tub through wash, rinse, and spin cycles.

A washing process of the laundry machine is described as follows. First, the wash cycle is carried out. During the wash cycle, an amount of laundry, such as clothes, put into the drum is measured, an amount of the wash water, an amount of the detergent, and a total wash time are determined based on the measured amount of the laundry, and then contaminants are separated from the laundry by friction between the wash water and the laundry through rotation of the drum for the total wash time.

When the wash cycle has been completed, the rinse cycle is carried out. During the rinse cycle, the dirty wash water in the tub is discharged to the outside, new wash water is supplied to the inside of the tub, and then the laundry is rinsed the designated number of times. Further, when the rinse cycle has been completed, the spin cycle is carried out. During the spin cycle, the water in the tub is discharged to the outside, the drum is rotated at a high speed such that moisture of the laundry is removed in a centrifugal separation manner. When the spin cycle has been completed, the laundry may be dried through an additional dry cycle.

In the conventional laundry machine, vibration generated due to rotation of a motor and the drum connected to the motor is directly transmitted to the tub. Since the motor is coupled with the tub, the vibration generated from the motor is directly transmitted to the tub. Therefore, springs or dampers are generally installed between the tub and a cabinet, thus damping vibration of the tub. In such a conventional laundry machine, in order to prevent the vibrating tub from interfering with the cabinet, the tub is separated from the cabinet by a designated interval. Therefore, in the conventional laundry machine, when the tub is enlarged to increase the capacity of the laundry machine, the cabinet must be enlarged accordingly, thus causing enlargement of the entire laundry machine. Further, as the size of the cabinet is increased, parts in the laundry machine and coupling structures thereof need to be changed.

DISCLOSURE OF INVENTION

Technical Problem

The present invention has been made in view of the above-mentioned problem, and an object of the present invention is to provide a laundry machine which has an increased capacity and improved vibration characteristics.

Solution to Problem

The objects of the present invention can be achieved by providing a laundry machine including a cabinet, a tub connected to vibration sources through a vibration transmission blocking member, a drum rotatably provided in the tub, a suspension unit to substantially damp and support the vibration sources, and ball balancers, each of which includes a race, balls contained in the race, and an oil filing the race, provided on the drum.

The vibration sources may include a motor provided with a rotary shaft connected to the drum, a bearing housing to support the rotary shaft of the motor, and a tub back wall, to which the bearing housing is connected, located on the rear surface of the tub, and the vibration transmission blocking member may be located between the tub back wall and the tub.

The suspension unit may be provided between the bearing housing and the cabinet. The suspension unit may include suspension brackets, each of which is provided with one end connected to the bearing housing, and damping and support members provided between the suspension brackets and a base of the cabinet and between the bearing housing and the base of the cabinet. The damping and support members may include cylinder springs and cylinder dampers provided between the suspension brackets and the base of the cabinet, and a cylinder spring provided between the bearing housing and the base of the cabinet. Balance weights may be provided on the suspension brackets.

A front ball balancer and a rear ball balancer may be provided on the front portion and the rear portion of the drum. The damping and support members provided between the suspension brackets and the base of the cabinet may be located between the front ball balancer and the rear ball balancer.

In a further aspect of the present invention, there is provided a laundry machine including a cabinet, a tub connected to vibration sources through a vibration transmission blocking member, a drum rotatably provided in the tub, a suspension unit to substantially damp and support the vibration sources, and ball balancers, each of which includes a race, balls contained in the race, and an oil filing the race, provided on the drum, wherein the balls have a size greater than a size determined by a theoretical function. The balls preferably have a size greater than 17 mm, and more preferably have a size of 19 mm.

In another aspect of the present invention, there is provided a laundry machine including a cabinet, a tub connected to vibration sources through a vibration transmission blocking member, a drum rotatably provided in the tub, a suspension unit to substantially damp and support the vibration sources, and ball balancers, each of which includes a race, balls contained in the race, and an oil filing the race, provided on the drum, wherein the number of the balls is a number determined by a theoretical function. The number of the balls is preferably 14.

In another aspect of the present invention, there is provided a laundry machine including a cabinet, a tub connected to vibration sources through a vibration transmission blocking member, a drum rotatably provided in the tub, a suspension unit to substantially damp and support the vibration sources, and ball balancers, each of which includes a race, balls contained in the race, and an oil filing the race, provided on the drum, wherein the race has a substantially square cross-section.

In another aspect of the present invention, there is provided a laundry machine including a cabinet, a tub connected to vibration sources through a vibration transmission blocking member, a drum rotatably provided in the tub, a suspension unit to substantially damp and support the vibration sources, and ball balancers, each of which includes a race, balls contained in the race, and an oil filing the race, provided on the drum, wherein an amount of the oil is more than a designated value. The amount of the oil is preferably 350 cc.

In another aspect of the present invention, there is provided a laundry machine including a cabinet, a tub connected to vibration sources through a vibration transmission blocking member, a drum rotatably provided in the tub, a suspension unit to substantially damp and support the vibration sources, and ball balancers, each of which includes a race, balls contained in the race, and an oil filing the race, provided on the drum, wherein a filling ratio of the oil is more than a designated value. The filling ratio of the oil is preferably more than 40%.

In yet another aspect of the present invention, there is provided a laundry machine including a cabinet, a tub connected to vibration sources through a vibration transmission blocking member, a drum rotatably provided in the tub, a suspension unit to substantially damp and support the vibration sources, and ball balancers, each of which includes a race, balls contained in the race, and an oil filing the race, provided on the drum, wherein a viscosity of the oil is more than a designated value. The viscosity of the oil is preferably more than 350 CS.

In yet another aspect of the present invention, the tub could be supported more rigidly than the drum is supported by the suspension unit.

In the laundry machine, the tub may be fixedly supported, or be supported by a flexible support structure, such as the suspension unit.

Further, the tub may be supported in an interim state between the fixed support and the flexible support.

That is, the tub may be flexibly supported by the suspension unit or be rigidly supported. For example, the tub may be supported by the suspensions, be supported by rubber bushings to provide less flexible movement than when supported by the suspensions, or be fixedly supported by being fixed somewhere by screws or so.

For another instance, the cases where the tub is supported more rigidly than when supported by the suspension unit are as follows.

Firstly, the tub may be made integrally with the cabinet.

Next, the tub may be supported by being fastened by screws, rivets, rubber bushings, etc. Also, the tub may be welded or bonded to the cabinet. In these cases, the supporting or fastening members have larger stiffness than a stiffness of the suspension unit with respect to the main direction of the vibration of the drum.

The tub may be expanded within the limits of a space in which the tub is placed. That is, the tub may be expanded until the circumferential surface thereof reaches (or almost reaches) a side wall or a side frame (for example, a left or right plate of a cabinet) restricting the size of the space at least in the lateral direction (the direction laterally perpendicular to the axial direction of the rotary shaft when the rotary shaft is horizontally placed). The tub may be made integrally with the lateral side walls of the cabinet.

The tub may be formed to be closer in the lateral direction to the wall or the frame than the drum. For example, the tub may be spaced away from the wall or the frame by an interval of less than 1.5 times an interval with the drum. Under the condition that the tub is enlarged in the lateral direction, the drum may also be enlarged in the lateral direction. Further, if the lateral interval between the tub and drum is reduced, the drum may be expanded in the lateral direction in direct proportion. When the lateral interval between the tub and the drum is reduced, the vibration of the drum in the lateral direction may be considered. The weaker the vibration of the drum in the lateral direction, the more expanded is the diameter of the drum. Therefore, the suspension unit to reduce the vibration of the drum may be designed such that rigidity of the suspension unit in the lateral direction is greater than rigidities of the suspension unit in other directions. For example, the suspension unit may be designed such that rigidity of the suspension unit against displacement in the lateral direction is greatest compared with rigidities of the suspension unit against displacements in other directions.

Further, the suspension unit may be directly connected to the bearing housing supporting the rotary shaft. That is, the bearing housing comprises a supporting portion to rotatably support the shaft and an extended portion extended from the supporting portion, and the suspension unit is attached to the supporting portion of the bearing housing or the extended portion of the bearing housing.

The suspension unit may include brackets extended in the axial direction. In a front loading type laundry machine, the brackets may be extended forward, namely towards a door.

The suspension unit may comprise at least two suspensions which are arranged distant from each other in the axial direction of the shaft.

The suspension unit may comprise suspensions placed below the shaft for standing support. The supported object (for example, the drum) is supported by the suspensions to stand alone.

Alternately, the suspension unit may comprise suspensions placed over the shaft for hanging support. In this case, the supported object is supported to be hung.

The mass center of the vibrating object (for example, a combination of the drum, the shaft, the bearing housing, and the motor) may be located, with respect to the center of the longitudinal length of the drum, at a side where the motor is located. In a front loading type laundry machine, the mass center may be located behind the longitudinal center of the drum. In this case, at least one suspension may be placed in front of or behind the mass center. One suspension may be placed in front of the mass center and another suspension behind the mass center.

The tub may be provided with an opening at a rear portion thereof. The drive assembly may be connected to the tub by a flexible member. The flexible member may seal between the tub and the drive assembly to prevent water from leaking through the opening of the rear portion of the tub, and allow the drive assembly to move relatively to the tub. The flexible member may be made of a flexible material which can do the sealing, for example, a gasket material like a front gasket. In this case, the flexible member may be referred to as a rear gasket for convenience. The rear gasket may be connected to the drive assembly under the condition that the rotation of the rear gasket at least in the rotational direction of the rotary shaft is constrained. In one embodiment, the flexible material may be directly connected to the shaft. In another embodiment, the flexible material may be connected to a portion of the bearing housing.

Further, a portion of the drive assembly, which is located radially inside the rear gasket and thus is likely to be exposed to the water in the tub, may be made so as no to be corroded by the water. For example, the portion of the drive assembly may be coated, or be surrounded with a separate member made of plastic such as the tub back (which will be described below). In a case where the portion of the drive assembly is made of metal, the portion may not be directly exposed to water by the coating or the separate plastic member, and thus corrosion of the portion may be prevented.

Further, the cabinet may not be necessary. For example, in a built-in laundry machine, the laundry machine without the cabinet may be installed within a space of a wall structure.

However, even in this case, a front plate forming the front face of the laundry machine may be required.

Advantageous Effects of Invention

As described above, a laundry machine in accordance with the present invention has effects, as follows.

In accordance with the present invention, the laundry machine has an increased capacity without increase in the size of a cabinet.

Further, in accordance with the present invention, the laundry machine employs an optimum ball balancer to satisfy a vibration reducing requirement, thus effectively controlling vibration of a drum.

BRIEF DESCRIPTION OF DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Hereinafter, a preferred embodiment of the present invention will be described in detail with reference to the accompanying drawings.

Now, with reference to FIGS. 1 and 2, a structure of a laundry machine 200 in accordance with this embodiment will be described.

Figure 1:
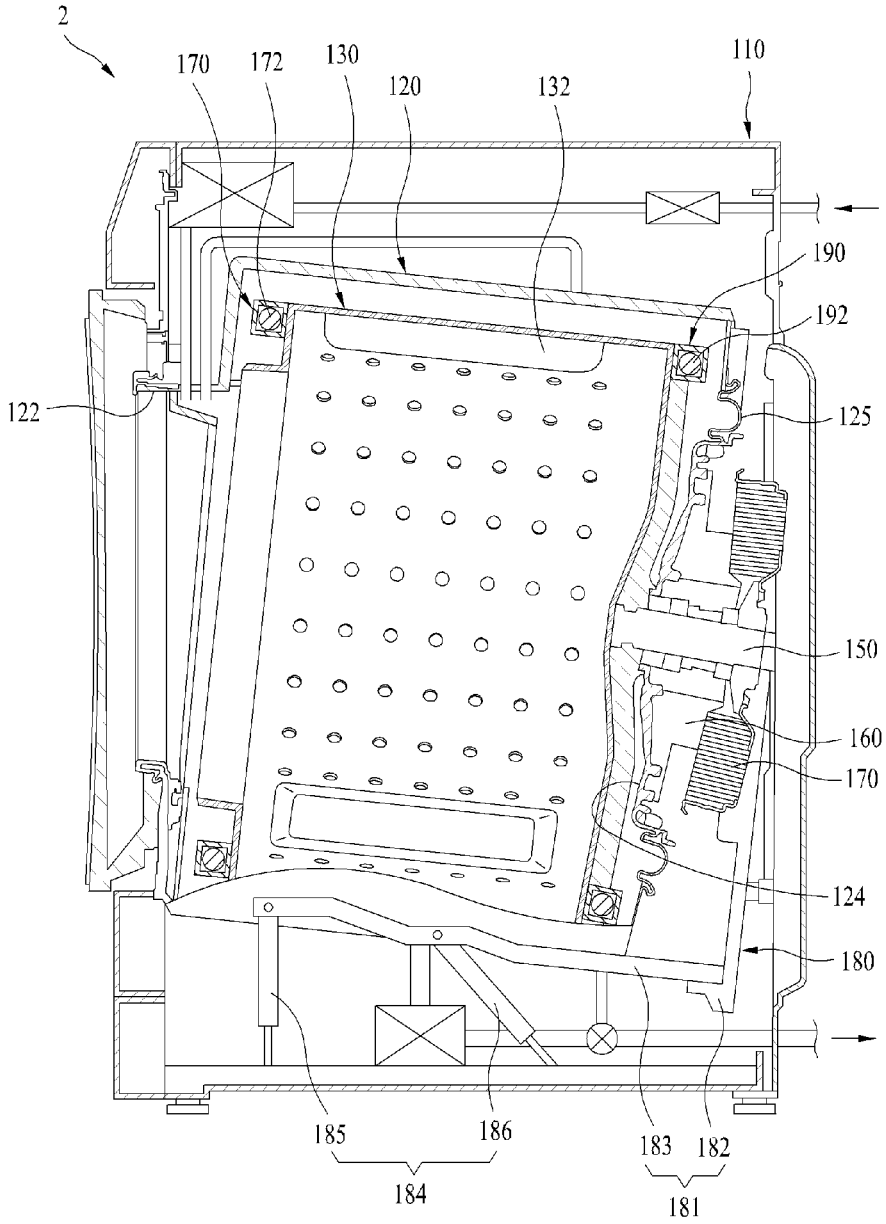
FIG. 1 is a schematic longitudinal-sectional view illustrating a drum laundry machine in accordance with a preferred embodiment of the present invention.
Figure 2:
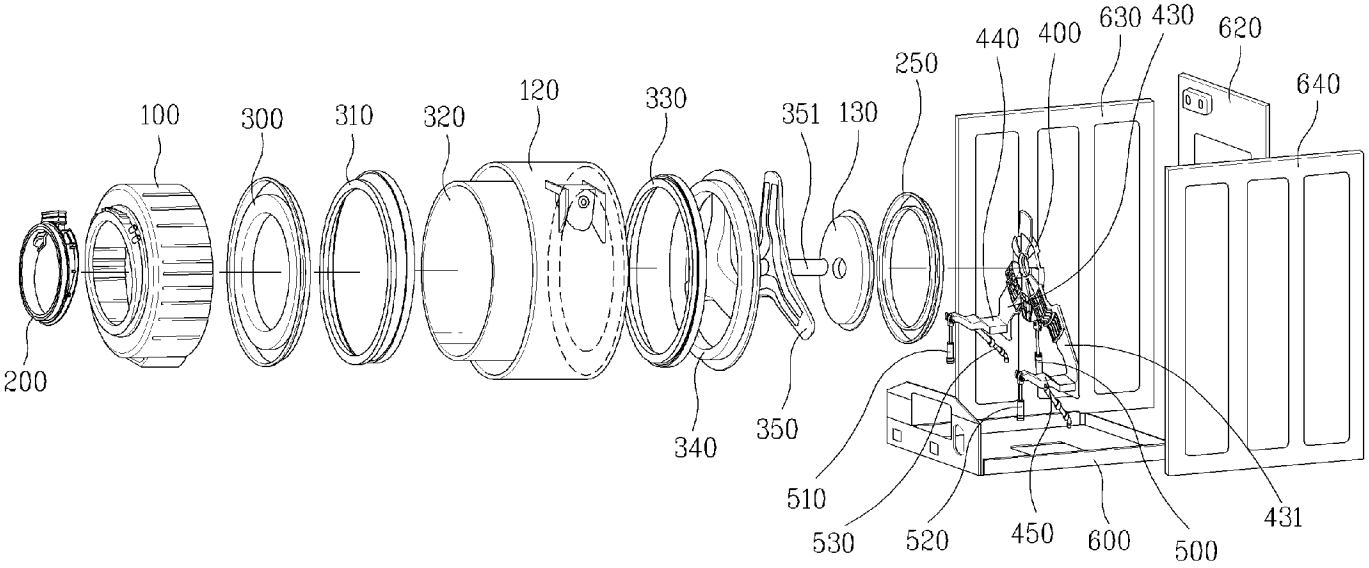
FIG. 2 is an exploded perspective view of FIG. 1.

With reference to FIGS. 1 and 2, the laundry machine 200 in accordance with the preferred embodiment of the present invention will be described. FIG. 1 is a schematic longitudinal-sectional view illustrating the laundry machine in accordance with this embodiment, and FIG. 2 is an exploded perspective view of FIG. 1.

Differing from the above-described conventional laundry machine, in the laundry machine 200 in accordance with this embodiment, a tub 12 is connected to vibration sources, such as a motor 170 and a drum 32 connected to the motor 170, by means of a vibration transmission blocking member 250 (hereinafter, referred to as a "rear gasket" for convenience) to intercept or damp vibration to prevent vibration generated from the vibration sources from being directly transmitted to the tub 12. The vibration sources are supported by a suspension unit 180. Therefore, in this embodiment, the tub 12 may be connected to a cabinet 110 without damping means, such as conventional springs and/or dampers, (a detailed description of this connection will be given later).

Now, the laundry machine in accordance with this embodiment will be described in detail.

In the laundry machine 200, the tub 12 is fixedly supported by the cabinet 110. Here, the fixed support means that the tub 12 is connected to the cabinet 110 without damping means. The tub 12 includes a tub front 100 forming the front portion of the tub 12, and a tub rear 120 forming the rear portion of the tub 12. The tub front 100 and the tub rear 120 are assembled by screws, and form a space in which the drum 32 is contained. The tub rear 120 is provided with an opening formed through a rear surface 280 thereof. The inner circumferential portion of the rear surface of the tub rear 120 is connected to the outer circumferential portion of the rear gasket 250. The inner circumferential portion of the rear gasket 250 is connected to a tub back 130. A through hole, through which a rotary shaft 350 passes, is formed through the center of the tub back 130. The rear gasket 250 serves to prevent vibration of the tub back 130 from being transmitted to the tub rear 120. Therefore, the rear gasket 250 is preferably made of a material and/or has a shape capable of absorbing vibration and/or having an insulating property. Further, the rear gasket 250 is vibrated also by vibration transmitted thereto, and thus is preferably made of a flexible material.

The tub rear 120 is provided with the rear surface 128. The rear surface 128 of the tub rear 120, the tub back 130, and the rear gasket 250 form a rear wall of the tub 12. The rear gasket 250 is connected to the tub back 130 and the tub rear 120 so as to achieve sealing between the rear gasket 250 and the tub back 130 and sealing between the rear gasket 250 and the tub rear 120 respectively, thereby preventing wash water in the tub 12 from leaking. The tub back 130 is vibrated together with vibration of the drum 32 when the drum 32 is rotated. Here, the tub back 130 is separated from the tub rear 120 by a sufficient interval to prevent interference of the tub back 130 with the tub rear 120. The rear gasket 250 is made of a flexible material, and thus allows the tub back 130 to move relative to the tub rear 120 without interference with the tub rear 120. The rear gasket 250 preferably includes a folding part 252 so as to be extended to a sufficient length to permit the relative movement of the tub back 130.

A foreign substance introduction preventing member 200 to prevent foreign substances from being introduced into a gap between the tub 12 and the drum 32 is interposed between the front portion of the tub front 100 and the front portion of the drum 32. The foreign substance introduction preventing member 200 is made of a flexible material, and is fixed to the tub front 100. The foreign substance introduction preventing member 200 may be made of the same material as the rear gasket 250. The foreign substance introduction preventing member 200 is referred to as a front gasket for convenience. In the conventional laundry machine, the tub is vibrated and thus a gasket is provided between the cabinet and the tub. On the other hand, in the laundry machine in accordance with this embodiment, the tub 12 is not substantially vibrated and thus no gasket is fundamentally required.

The drum 32 includes a drum front 300, a drum center 320, and a drum back 340. Further, ball balancers 310 and 330 are installed at the front portion and the rear portion of the drum 32. The drum back 340 is connected to a spider 350, and the spider 350 is connected to a rotary shaft 351. The drum 32 is rotated within the tub 12 by rotary force transmitted through the rotary shaft 351.

The rotary shaft 351 passes through the tub back 130, and is directly connected to the motor 170. More concretely, a rotor 172 of the motor 170 and the rotary shaft 351 are directly connected to each other. A bearing housing 400 is connected to the rear surface of the tub back 130. Further, the bearing housing 400 rotatably supports the rotary shaft 351 between the motor 170 and the tub back 130.

A stator 174 of the motor 170 is fixedly installed at the bearing housing 400. Further, the rotor 172 is installed so as to surround the stator 174. As described above, the rotor 172 is directly connected to the rotary shaft 351. Here, the motor 170 is an outer rotor-type motor, and is directly connected to the rotary shaft 351.

The bearing housing 400 is supported by a cabinet base 600 through a suspension unit 180. The suspension unit 180 preferably includes three vertical damping and support members, and two inclined damping and support members inclined forwardly and backwardly.

For example, the suspension units 180 includes a first cylinder spring 520, a second cylinder spring 510, a third cylinder spring 500, a first cylinder damper 540 (installed symmetrically to a second cylinder damper with reference to FIG. 1), and the second cylinder damper 530 as damping and support members.

The first cylinder spring 520 is connected between a first suspension bracket 450 and the base 600. Further, the second cylinder spring 510 is connected between a second suspension bracket 440 and the base 600. The third cylinder spring 500 is directly connected between the bearing housing 400 and the base 600. The first cylinder damper 540 is inclined between the first suspension bracket 450 and the rear portion of the base 600. The second cylinder damper 530 is inclined between the second suspension bracket 440 and the rear portion of the base 600. Further, the suspension brackets 450 and 440 are connected to the bearing housing 400 by a first balance weight 431 and a second balance weight 430.

The cylinder springs 520, 510, and 500 of the suspension unit 180 are not connected to the cabinet base 600 in a completely fixed manner, but are connected to the cabinet base 600 such that the cylinder springs 520, 510, and 500 may be elastically deformed to some extent so as to allow the drum to move back and forth and left and right. That is, the cylinder springs 520, 510, and 500 are elastically supported such that rotation of the cylinder springs 520, 510, and 500 to some degrees back and forth and left and right is permitted around support points thereof where the cylinder springs 520, 510, and 500 are connected to the cabinet base 600. Among the suspension unit 180, the vertical damping and support members elastically damp vibration of the drum 32, and the inclined damping and support members reduce vibration of the drum 32. That is, the vertical damping and support members may serve as springs and the inclined damping and support members may serve as damping means in a vibration system including the springs and the damping means.

As described above, the tub 12 is fixedly installed in the cabinet 110, and vibration of the drum 32 is damped by the suspension unit 180. The laundry machine in accordance with this embodiment is of a type in which a support structure of the tub 12 and a support structure of the drum 32 are substantially separated from each other, and thus although the drum 32 is vibrated, the tub 12 is not vibrated. That is, vibration generated from the driving motor 170 and transmitted to the tub back 130 is not transmitted to the tub 12 by means of the rear gasket 250. That is, in the laundry machine in accordance with this embodiment, if vibration is generated by rotation of the motor 170 and the drum 32, the tub 12 is not vibrated in connection with the vibration of the drum 32. Therefore, the tub 12 in accordance with this embodiment may be directly connected to the cabinet 110 without damping means. The tub 12 may be fixed to the inside of the cabinet 100 by separate coupling members (for example, screws, or bolts). In this embodiment, the tub 12 is not substantially vibrated and thus may be directly connected to the cabinet 110, and a space between the tub 12 and the cabinet 110 is minimized and thus the size of the drum 32 installed in the cabinet 110 having the given size may be increased.

If the drum 32 of the laundry machine is rotated under the condition that laundry is contained in the drum 32, there is a possibility that strong vibration is generated according to distribution of the laundry in the drum 32. For example, when the drum 32 is rotated in an unbalance state in which laundry is not uniformly distributed in the drum 32, vibration may be increased. Particularly, if the drum 32 is rotated at a high speed so as to carry out the spin cycle, vibration may become an issue.

Therefore, in order to compensate for unbalance of the laundry in the drum 32 during rotation of the drum 32, the laundry machine includes the ball balancers 310 and 330. The ball balancers 310 and 330 may be provided at the front portion and the rear portion of the drum 32.

Among the damping and support members, the damping and support members which are provided between the suspension brackets 440 and 450 and the base 600, i.e., the first cylinder spring 520, the second cylinder spring 510, the first cylinder damper 540, and the second cylinder damper 530 are preferably located under the drum 130 and disposed between the front ball balancer 310 and the rear ball balancer 320. This disposition causes balance of the laundry in the drum 32 between the front and rear portions of the drum 32, and thus effective reduction of the vibration of the drum 32 may be achieved by the front ball balancer 310 and the rear ball balancer 330.

Hereinafter, a structure of the ball balancers 310 and 330 will be described in detail.

The front ball balancer 310 includes a race 312*a*, balls 312 freely movably contained in the race 312*a*, and oil filling the inside of the race 312*a* to adjust movement of the balls 312. The balls 312 are generally made of steel, and silicon-based lubricating oil is generally used as the oil.

Figure 3:
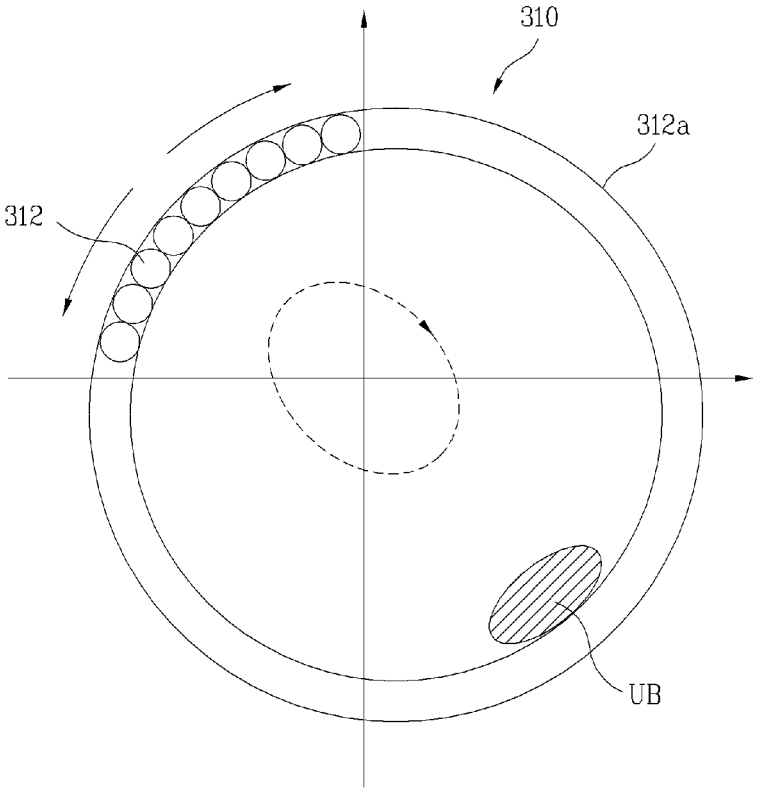
FIG. 3 is a view illustrating an operation principle of a ball balancer.

With reference to FIG. 3, an operation principle of the ball balancer 310 will be described, as follows.

When the drum 32 starts to be rotated, the drum 32 may be rotated under the condition that the dynamic balance of the drum 32 is not maintained due to the eccentric structure of the drum 32 itself and the unbalanced distribution of the laundry in the drum 32. Here, the balls 312 compensate for the dynamic unbalance (UB) of the drum 32, and thus the drum 32 may maintain dynamic balance. That is, when dynamic unbalance (UB) occurs in the drum 32, the balls 32 move to a position symmetrical to the position at which the dynamic unbalance (UB) occurs, and thus compensate for the unbalance in the drum 32.

However, location of the balls 312 at the position in the opposite direction of the unbalance (hereinafter, referred to as "balancing of the balls 312" at all rotating velocities of the drum 32 so as to compensate for the dynamic unbalance in the drum 32 is difficult. A difference of rotating velocities between the drum 32 and the balls 312 is generated at a certain rotating velocity of the drum 32, and it is difficult for the balls 312 to reach the balancing position due to such a difference.

Further, in a section where the rotating velocity of the drum 32 is increased, the position of the balls 312 may be changed and thus the balancing of the balls 312 may not be achieved. It may be generated also after the balls 312 are balanced. The more separately distributed the balls 312 and the closer to 90 degrees an angle between the position of the balls 312 and the position of the unbalance, the more unstable is the balancing achieved by the balls 312. Therefore, in order to effectively achieve the balancing of the balls 312, the size and the number of the balls 312, the shape of the race 312*a*, and the viscosity and the filling degree of the oil must be selected in consideration of vibration characteristics of the laundry machine.

As described above, the ball balancer serves to compensate for unbalance of laundry, and particularly, to properly control vibration generated during the spin cycle. Therefore, in order to cause the ball balancer to effectively compensate for the unbalance of laundry, it is necessary to properly design the structure of the ball balancer. However, since the actual operation of the ball balancer may not coincide with the theoretical design of the ball balancer, it is necessary to design a ball balancer which is effectively operated in actual use. The structure of the ball balancer in consideration of the above fact will be described, as follows.

Figure 4:
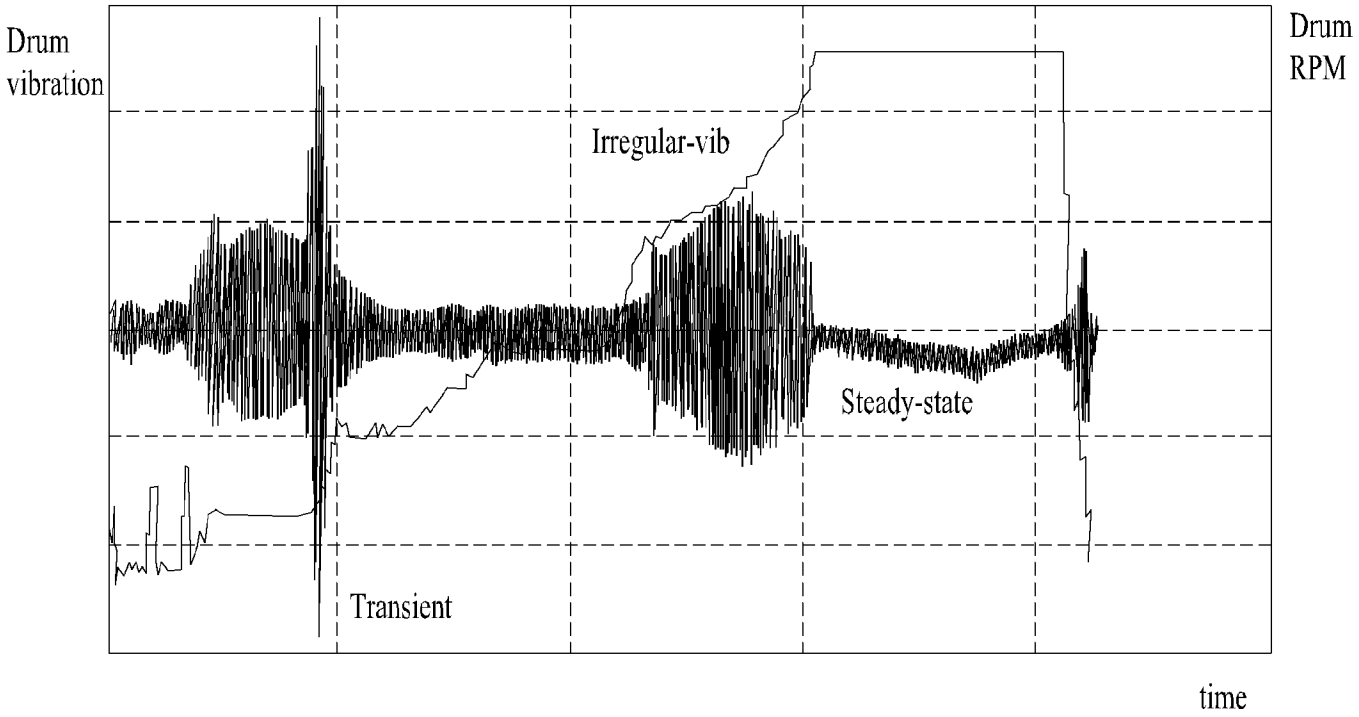
FIG. 4 is a view illustrating vibration characteristics of the drum laundry machine of FIG. 1.

Since the design of the ball balancer is closely related to vibration characteristics of the laundry machine, as described above, vibration characteristics of the laundry machine in accordance with this embodiment will be first described, with reference to FIG. 4.

As the rotating velocity of the drum increases, a region (hereinafter, referred to as a "transient vibration region), where transient vibration having a wide and irregular amplitude is generated, occurs. The transient vibration region occurs prior to a region (hereinafter, referred to as a "steady-state vibration region"), where comparatively steady vibration is generated, and is usually determined when a vibration system (laundry machine) is designed. In the laundry machine in accordance with this embodiment, transient vibration occurs at a region of approximately 200~350 rpm, and is regarded as transient vibration due to resonance. Therefore, the design of the ball balancer in consideration of effective ball balancing in the transient vibration region is required.

On the other hand, in the laundry machine in accordance with this embodiment, the vibration sources, i.e., the motor 170 and the drum 32 connected to the motor 170, are connected to the tub 12 through the rear gasket 250, as described above. Therefore, vibration generated from the drum 32 is scarcely transmitted to the tub 12, and the drum 32 is supported by the damping and support means (damping system), i.e., the suspension unit 180, through the bearing housing 400. Therefore, the tub 11 may be directly fixed to the cabinet 110 without damping means (with reference to FIG. 1).

As research results of the inventor(s) of the present invention, vibration characteristics, which are not found from a general laundry machine, were found from the laundry machine in accordance with this embodiment. In the general laundry machine, when the transient vibration region has passed, vibration is decreased and then stabilized. On the other hand, in the laundry machine in accordance with this embodiment, vibration (hereinafter, referred to as "irregular vibration"), which is stabilized and then is increased again, occurred after the transient vibration region has passed. As the research results, the irregular vibration occurred at a region of approximately 400~1,000 rpm (hereinafter, referred to as an "irregular vibration region). It is thought that the irregular vibration is caused by the use of the ball balancer, the damping and support means (damping system), and the rear gasket. Therefore, in this laundry machine, the design of the ball balancer in consideration of the irregular vibration region as well as the transient vibration region is required. That is, it is preferable that factors of the structure of the ball balancer 310, i.e., the size and the number of the balls 312, the shape of the race 312*a*, and the viscosity and the filling degree of the oil be selected in consideration of the irregular vibration region as well as the transient vibration region. If the transient vibration region and/or the irregular vibration region, particularly, the irregular vibration region is considered, it is preferable that the outer diameter of the ball balancer 310 is approximately 255.8 mm, the inner diameter of the ball balancer 310 is 249.2 mm, the cross-sectional area of the race 312*a* containing the balls 312 is 411.93 $mm^2$, the number of the balls 312 is 14, the size of the balls 312 is 19.05 mm, the oil is Poly Dimethysiloxane (PDMS) which is one of silicon-based oil, the viscosity of the oil is 300 CS at room temperature, and the filling amount of the oil is 350 cc.

Hereinafter, the factors for the design of the ball balancer, i.e., the size and the number of the balls, the shape of the race, and the viscosity and the filling degree of the oil, in consideration of the transient vibration region and/or the irregular vibration region, particularly, the irregular vibration region will be described in more detail, with reference to FIGS. 5 to 10.

First, the size and the number of the balls will be described, with reference to FIGS. 5 to 7.

When an amount of the unbalance to be compensated for is determined, the capacity of the ball balancer, i.e., the size and the number of the balls are selected corresponding to the determined amount of the unbalance. For example, if the amount of the unbalance to be compensated for is 350 g, the ball balancer is designed so as to have a capacity of 350 g. The capacity of the ball balancer is a function of the size and the number of the balls. That is, the capacity of the ball balancer is obtained by the function of [weight per ball (capacity of a ball specific gravity of the ball) the number of balls]. Therefore, under the same capacity of the ball balancer, if the size of the balls is small, the number of the balls needs to be increased, and if the size of the balls is large, the number of the balls may be decreased. However, if the size of the balls is excessively small, noise due to collision of the balls may become issue, and if the size of the balls is excessively large, the sizes of the ball balancer and the drum are increased and thus when a central angle determined by the balls is more than a designated angle, noise is increased. Therefore, the upper limit and the lower limit of the number of the balls in consideration of noise and the size of the ball balancer are approximately set.

Figure 5:
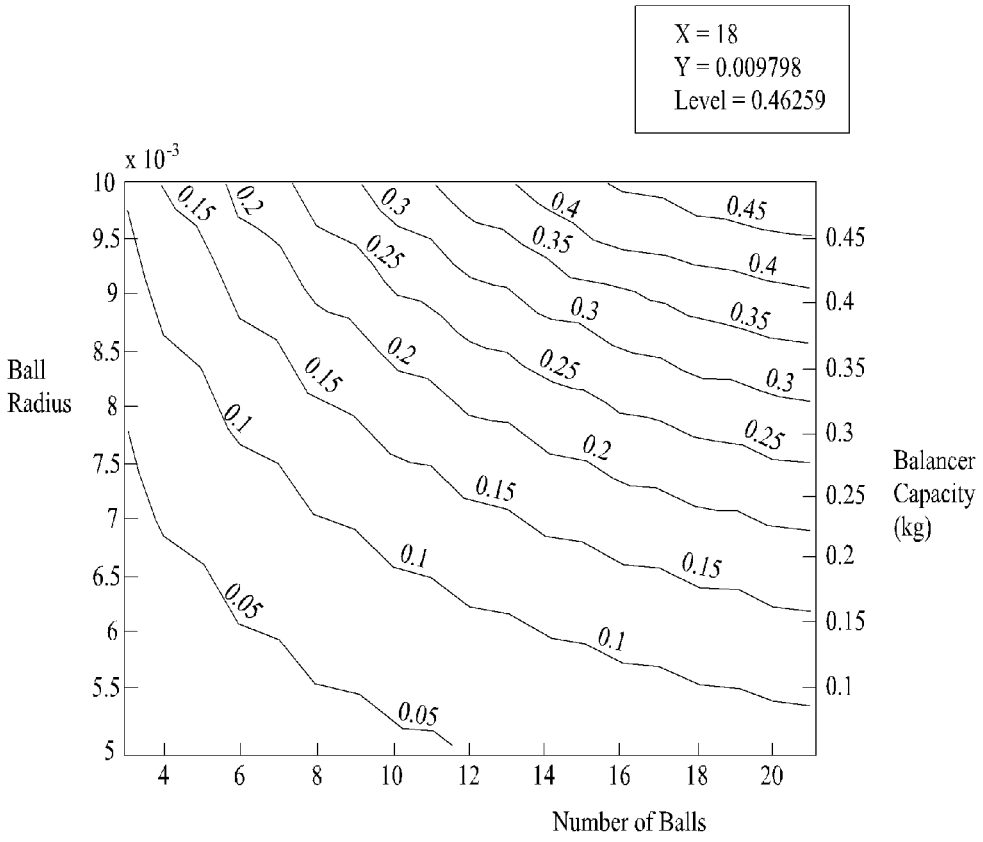
FIG. 5 is a graph illustrating relation among capacity of a ball balancer, the number of balls, and size of the balls.

As shown in FIG. 5, in consideration of noise due to collision of the balls and the size of the ball balancer, it is preferable that the number of the balls be approximately 4~20. Further, if the capacity of the ball balancer is 350 g, the minimal size of the balls is approximately 17 mm.

Figure 6:
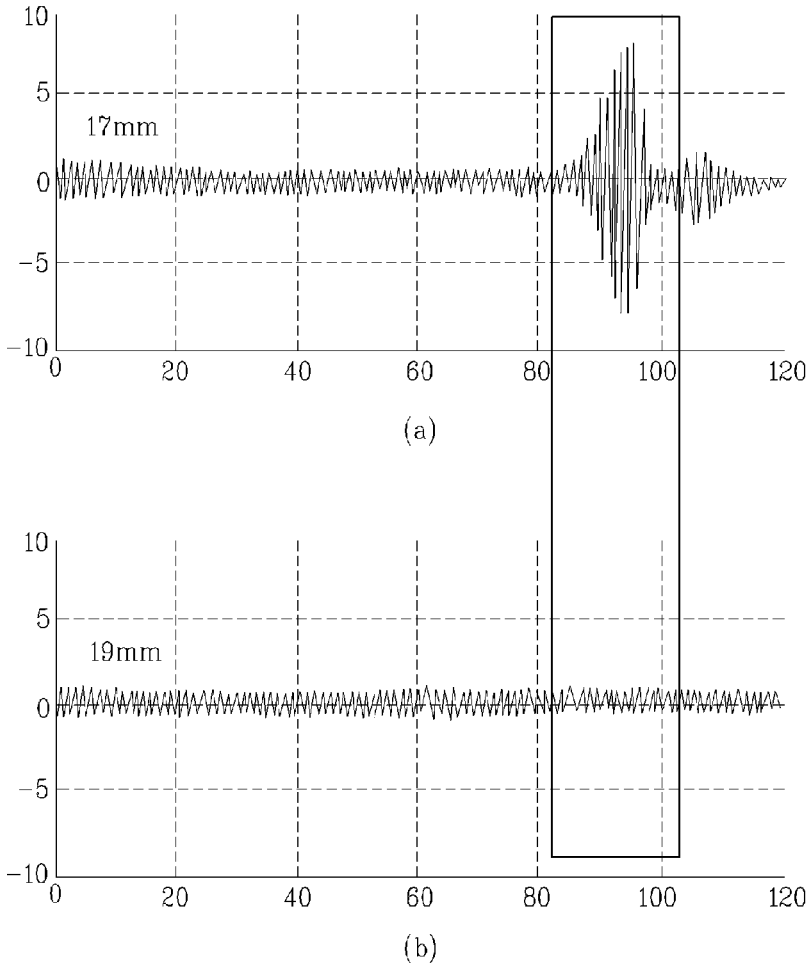
FIGS. 6(*a*) and 6(*b*) are graphs illustrating vibration characteristics according to size of balls.
Figure 7:
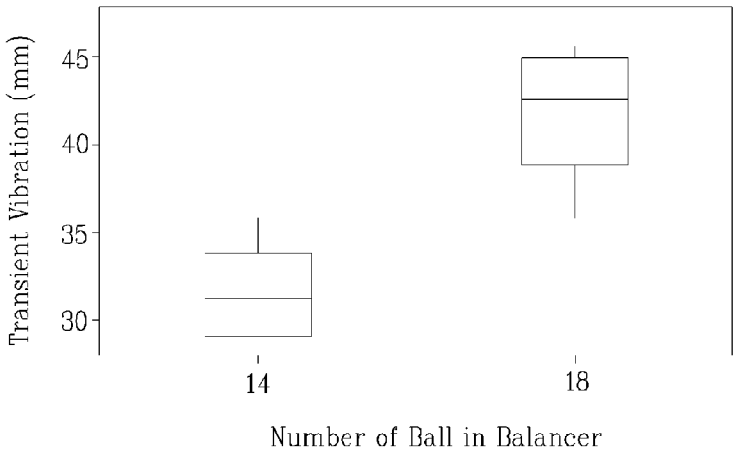
FIG. 7 is a graph illustrating vibration characteristics according to the number of balls.

According to the research results of the inventor(s) of the present invention, in the laundry machine accordance with this embodiment, if balls having a size of 17 mm determined by the theoretical function are used, irregular vibration occurred, and if balls having a size of more than 17 mm are used, irregular vibration did not occur, as shown in FIGS. 6(*a*) and 6(*b*). Further, vibration in the transient vibration region if the number of the balls corresponding to the size of 17 mm is 18 was also greater than vibration in the transient vibration region if the number of the balls corresponding to the size of 19 mm is 14.

It is thought that during actual operation of the laundry machine, the size of the balls determined by the theoretical function is excessively small, and thus centrifugal force applied to the balls is reduced and frictional force to prevent movement of the balls is reduced, and thereby positions of the balls are diffused and cause irregular vibration. Therefore, it is preferable that the size of the balls be larger than the size determined by the theoretical function and the number of the balls be determined based on the obtained size of the balls.

Next, the shapes of the race 312*a* of the ball balancer 310 will be described, with reference to FIGS. 8(*a*) to 8(*c*).

It is preferable that the shape of the race 312*a*, the size of the race 312*a*, the size of the balls 312, and the viscosity of the oil 312*b* be determined in consideration of vibration characteristics of the laundry machine. FIG. 8(*a*) illustrates the race 312*a* having a substantially square cross-sectional shape in which the cross-sectional area of the ball 312 is 437 $mm^2$ and the cross-sectional area of the race 312*a* except for the ball 312 is 152 $m^2$, FIG. 8(*b*) illustrates the race 312*a* having a substantially square cross-sectional shape in which the cross-sectional area of the ball 312 is 412 $mm^2$ (reduced by 6% compared with the race 312*a* of FIG. 8(*a*)) and the cross-sectional area of the race 312*a* except for the ball 312 is 127 $mm^2$ (reduced by 16% compared with the race 312*a* of FIG. 8(*a*)), and FIG. 8(*c*) illustrates the race 312*a* having a substantially rectangular cross-sectional shape.

Figure 8:
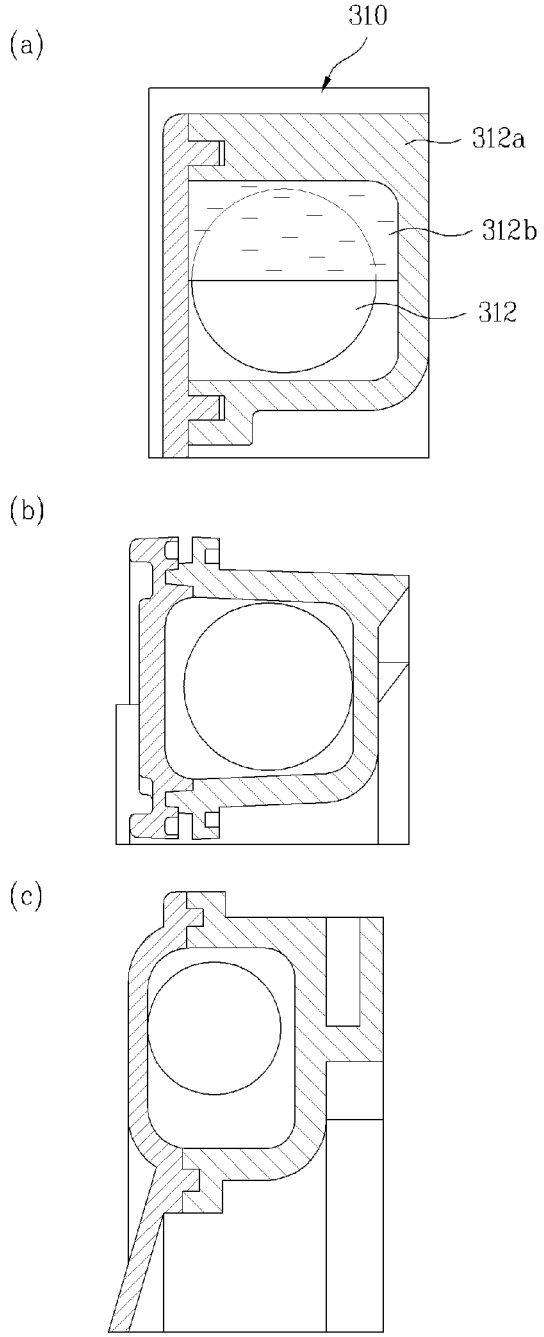
FIGS. 8(*a*) to 8(*c*) are longitudinal-sectional views schematically illustrating race structures applied to the ball balancer.
Figure 9:
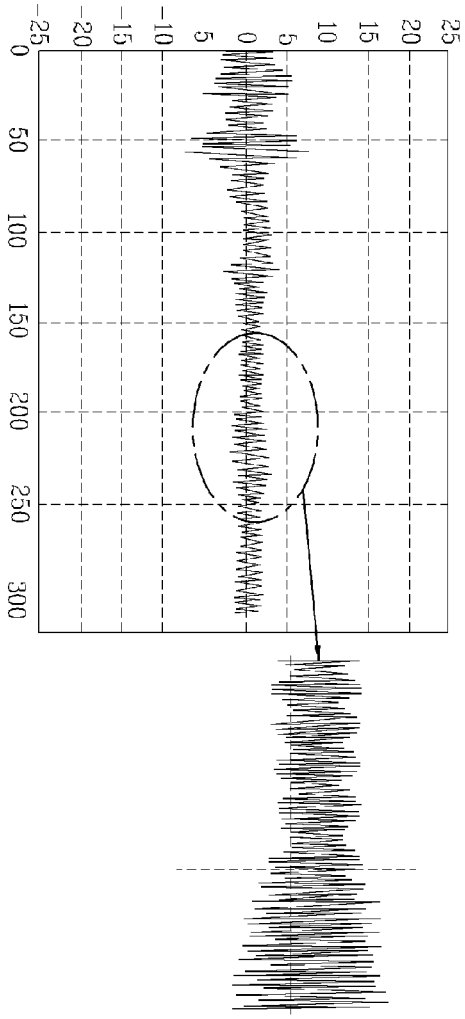
FIG. 9 is a graph illustrating vibration characteristics according to race structure of the ball balancer.

According to the research results, the races 312*a* having a substantially rectangular cross-sectional shape, as shown in FIGS. 8(*a*) and 8(*b*), were advantageous. That is, the races 312*a* of FIGS. 8(*a*) and 8(*b*) have similar performances in the transient vibration region and the steady-state vibration region, and the race 312*a* of FIG. 8(*b*) has excellent performance in the irregular vibration region. However, the race 312*a* of FIG. 8(*c*) generates high vibration in the irregular vibration region, as shown in FIG. 9. It is thought that the race 312*a* of FIG. 8(*c*) has a large cross-sectional shape and thus movement of the balls 312 easily occurs. Therefore, it is preferable that the race have a substantially square cross-sectional shape. Further, it is preferable that the balls be comparatively densely distributed in the race.

Figure 10:
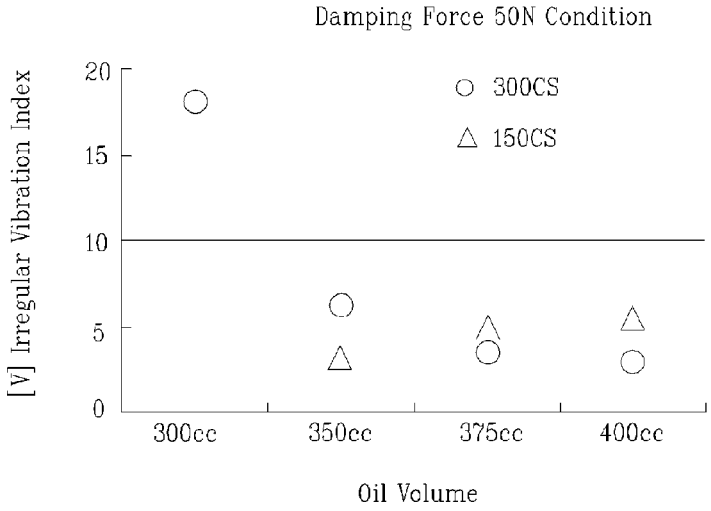
FIG. 10 is a graph illustrating vibration characteristics according to viscosity and filling amount of oil of the ball balancer.

Next, the viscosity of the oil and the filling amount of the oil in the race, i.e., a filling ratio of the oil will be described, with reference to FIG. 10.

As research results, it is thought that the viscosity of the oil and the filling ratio of the oil also affect irregular vibration. First, if the amount of the oil is less than approximately 350 cc, irregular vibration was impermissibly high. Therefore, it is preferable that the amount of the oil be more than 350 cc. If the amount of the oil is more than 350 cc, a difference in generation of the irregular vibration was not remarkable. However, if the amount of the oil is increased, the amount of the oil caused a large resistance to movement of the balls and it was difficult to sense unbalance of laundry in the drum. That is, an unbalance sensing time and dispersion were increased. Therefore, it is preferable that the amount of the oil be 300 cc. Further, the amount of the oil is regarded as the filling ratio (amount of oil/inner volume of race) in connection with the shape of the race 132*a*, and the filling ratio is preferably more than 40%, and more preferably more than 60%.

Further, if the viscosity of the oil is less than a designated value, i.e., less than at least 300 CS at room temperature, generation of irregular vibration become issue. Therefore, it is preferable that the viscosity of the oil be more than 300 CS.

Mode for the Invention

Various embodiments have been described in the best mode for carrying out the invention.

INDUSTRIAL APPLICABILITY

As is apparent from the above description, a laundry machine in accordance with the present invention has effects, as follows.

In accordance with the present invention, the laundry machine has an increased capacity without increase in the size of a cabinet.

Further, in accordance with the present invention, the laundry machine employs an optimum ball balancer to satisfy a vibration reducing requirement, thus effectively controlling vibration of a drum.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

For example, the above-described principle for designing the ball balancer may be applied to other laundry machines. That is, although one embodiment of the present invention illustrates a laundry machine (hereinafter, referred to a "tub fixation type laundry machine") in which a tub is connected to vibration sources including a motor through a vibration damping member (rear gasket) and thus the tub is directly connected to a cabinet, this principle may be applied to a conventional laundry machine having a general damping structure.

The invention claimed is:

1. A laundry machine comprising:
- a cabinet;
- a tub provided in the cabinet;
- a drum rotatably provided in the tub;
- a rotary shaft connected to the drum;
- a motor coupled to the rotary shaft;
- a bearing housing to rotatably support the rotary shaft;
- a tub back wall connected to the bearing housing;
- a vibration transmission blocking member provided between the tub back wall and the tub;
- a suspension unit connected to the bearing housing; and
- ball balancers, each of which includes a race, balls contained in the race, and an oil filing the race, provided on the drum,
- wherein the balls have a size greater than a size determined by capacity of the ball balancers=a volume of ball x a specific gravity of ball x the number of ball, whereby an irregular vibration caused by connecting the suspension unit to the bearing housing is prevented.

2. The laundry machine according to claim 1, wherein the suspension unit is provided between the bearing housing and the cabinet.

3. The laundry machine according to claim 2, wherein the suspension unit includes suspension brackets, each of which is provided with one end connected to the bearing housing, and damping and support members provided between the suspension brackets and a base of the cabinet and between the bearing housing and the base of the cabinet.

4. The laundry machine according to claim 3, wherein the damping and support members include cylinder springs and cylinder dampers provided between the suspension brackets and the base of the cabinet, and a cylinder spring provided between the bearing housing and the base of the cabinet.

5. The laundry machine according to claim 4, wherein balance weights are provided on the suspension brackets.

6. The laundry machine according to claim 3, wherein a front ball balancer and a rear ball balancer are provided on the front portion and the rear portion of the drum.

7. The laundry machine according to claim 6, wherein the damping and support members provided between the suspension brackets and the base of the cabinet are located between the front ball balancer and the rear ball balancer.

8. The laundry machine according to claim 1, wherein the balls have a size greater than 17 mm.

9. The laundry machine according to claim 8, wherein the balls have a size of 19 mm.

10. The laundry machine according to claim 1, wherein the number of the balls is 14.

11. The laundry machine according to claim 1, wherein the race has a substantially square cross-section.

12. The laundry machine according to claim 1, wherein the tub is supported more rigidly than the drum is supported by the suspension unit.

13. The laundry machine of claim 1, wherein the filling ratio of the oil is more than 40%.

14. The laundry machine of claim 13, wherein the amount of oil is 350 cc.

15. A laundry machine comprising:

a cabinet;

a tub provided in the cabinet;

a drum rotatably provided in the tub;

a rotary shaft connected to the drum;

a motor coupled to the rotary shaft;

a bearing housing to rotatably support the rotary shaft;

a tub back wall connected to the bearing housing;

a vibration transmission blocking member provided between the tub back wall and the tub;

a suspension unit connected to the bearing housing; and ball balancers, each of which includes a race, balls contained in the race, and an oil filing the race provided on the drum, wherein the amount of the oil is 350 cc whereby an irregular vibration caused by connecting the suspension unit to the bearing housing is prevented.

16. A laundry machine comprising:

a cabinet;

a tub provided in the cabinet;

a drum rotatably provided in the tub;

a rotary shaft connected to the drum;

a motor coupled to the rotary shaft;

a bearing housing to rotatably support the rotary shaft;

a tub back wall connected to the bearing housing;

a vibration transmission blocking member provided between the tub back wall and the tub;

a suspension unit connected to the bearing housing; and ball balancers, each of which includes a race, balls contained in the race, and an oil filing the race provided on the drum, wherein the filling ratio of the oil is more than 40% whereby an irregular vibration caused by connecting the suspension unit to the bearing housing is prevented.

* * * * *